US005496406A

United States Patent [19]

Beisswanger et al.

[11] Patent Number: 5,496,406

[45] **Date of Patent: * Mar. 5, 1996**

[54] COATING DEVICE HAVING INFRARED AND SUSPENSION DRYING SECTIONS

[75] Inventors: Rudolf Beisswanger, Steinheim; Martin Kustermann, Heidenheim, both of Germany

[73] Assignee: J. M. Voith GmbH, Heidenheim, Germany

[ * ] Notice: The portion of the term of this patent subsequent to Apr. 2, 2012, has been disclaimed.

[21] Appl. No.: 286,534

[22] Filed: Aug. 5, 1994

[30] Foreign Application Priority Data

| | | | |
|---|---|---|---|
| Aug. 7, 1993 | [EP] | European Pat. Off. | 93112695 |
| Jan. 5, 1994 | [DE] | Germany | 44 00 158.4 |

[51] Int. Cl.[6] ..... B05B 1/24

[52] U.S. Cl. ..... 118/643; 118/62; 118/67; 118/68; 118/244; 118/249; 118/413; 34/68; 34/273; 34/420

[58] Field of Search ..... 118/62, 63, 67–68, 118/118, 244, 246, 249, 413, 641–643; 34/68, 267, 273, 420, 421, 640, 643

[56] References Cited

U.S. PATENT DOCUMENTS

| | | | |
|---|---|---|---|
| 2,729,192 | 1/1956 | Warner | 118/117 |
| 2,946,307 | 7/1960 | Warner | 118/119 |
| 3,084,663 | 4/1963 | Warner | 118/118 |
| 3,650,043 | 3/1972 | Overly et al. | 345/643 |
| 3,957,187 | 5/1976 | Puigrodon | 34/643 |
| 4,561,578 | 12/1985 | Kishido et al. | 118/62 |
| 4,767,042 | 8/1988 | Daane | 34/643 |
| 4,848,268 | 7/1989 | Sollinger et al. | 118/227 |
| 5,112,653 | 5/1992 | Damrau et al. | 427/356 |
| 5,147,690 | 9/1992 | Faust et al. | 118/63 |
| 5,156,312 | 10/1992 | Kurie | 34/643 |
| 5,230,165 | 7/1993 | Beisswanger | 34/60 |
| 5,299,362 | 4/1994 | Baldinger | 34/273 |

FOREIGN PATENT DOCUMENTS

| | | |
|---|---|---|
| 507218 | 10/1992 | European Pat. Off. . |
| 8414413 | 1/1988 | Germany . |

*Primary Examiner*—Laura Collins

*Attorney, Agent, or Firm*—Marshall, O'Toole, Gerstein, Murray & Borun

[57] ABSTRACT

A device for coating a paper web includes two applicator rolls disposed parallel to one another, forming a roll gap for the passage of a paper web therethrough. At least one applicator for applying a coating onto a surface of at least one of the rolls is also provided. The coating roll thereafter transfers the coating onto one side of a paper web disposed in the roll gap. Guide elements disposed downstream of the roll gap with respect to a direction of travel of the paper web through the device include at least one beam-like air guide element adapted to create an air cushion-between the paper web and a surface of the air guide element facing the paper web. The air guide element is disposed in such a manner as to deflect a paper web at least once downstream the roll gap. At least one air guide element is disposed directly downstream of the roll gap at a distance from the roll gap of about 0.3 times to about 1 time the diameter of at least one of the rolls.

8 Claims, 11 Drawing Sheets

10
11
A
20
IR
AF
AT
86
88
90
92
94

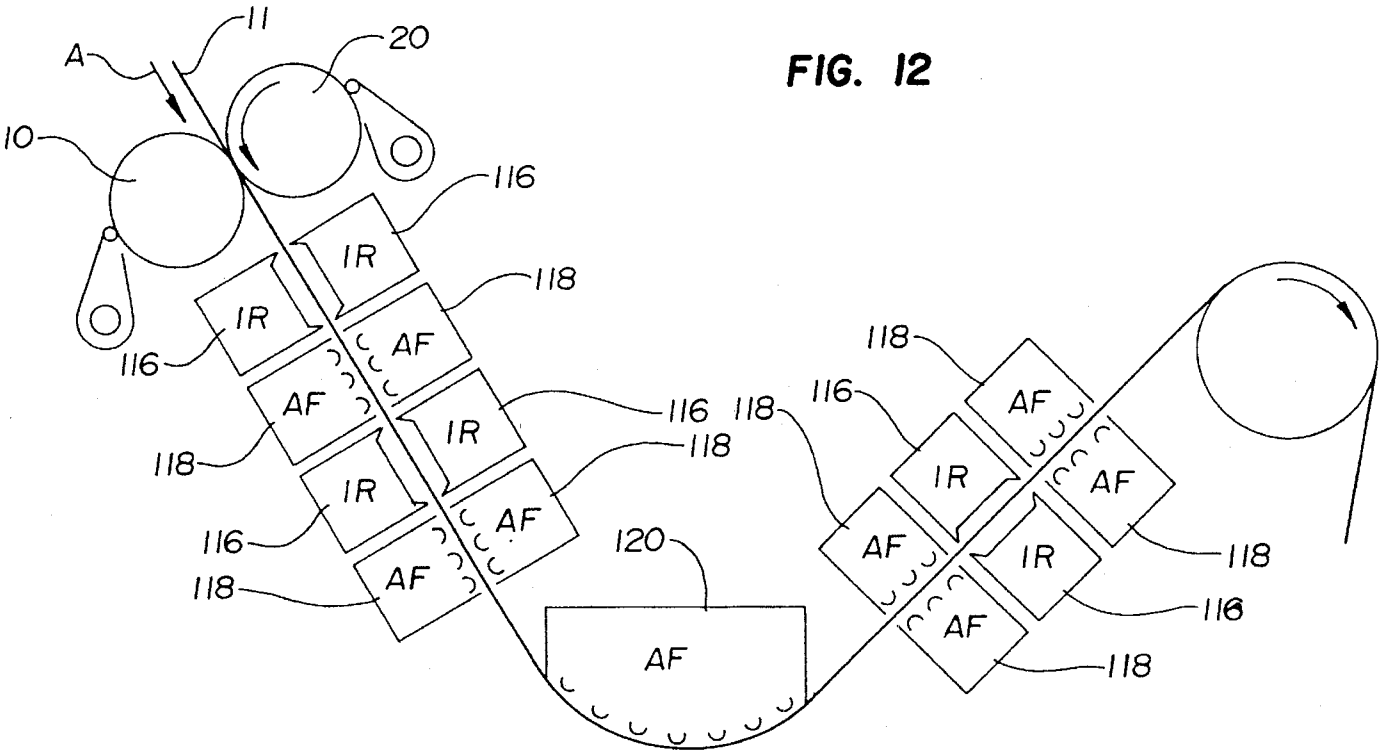
FIG. 12
10
11
A
20
IR
AF
116
118
120
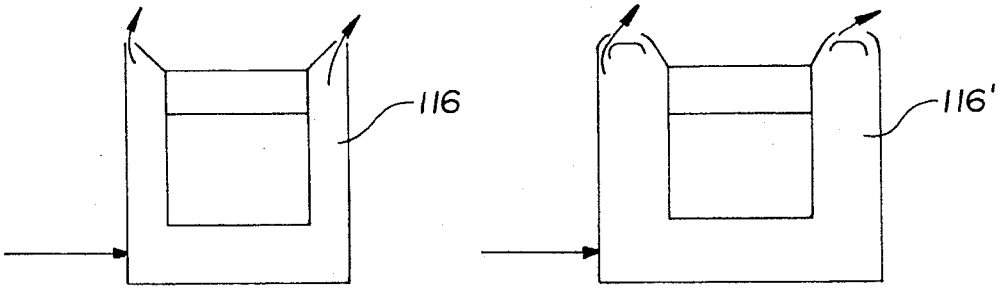
FIG. 12a
FIG. 12b
116
116'

FIG. 14a
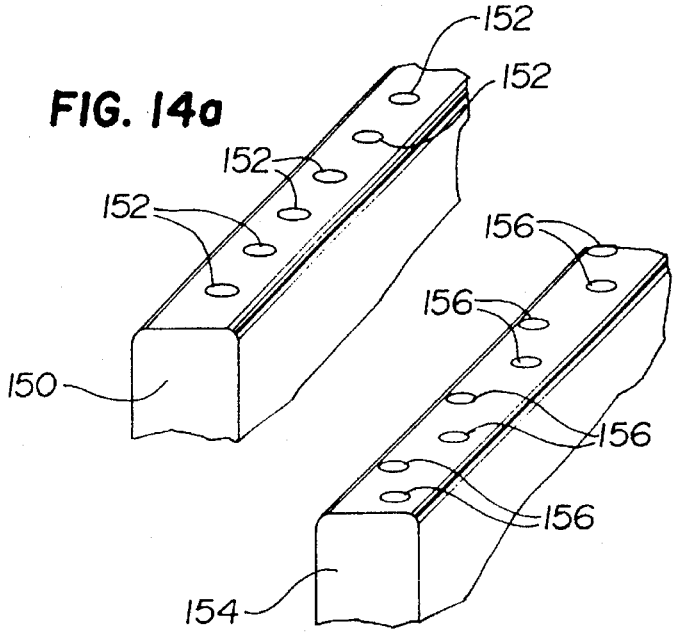
FIG. 14b
FIG. 14c
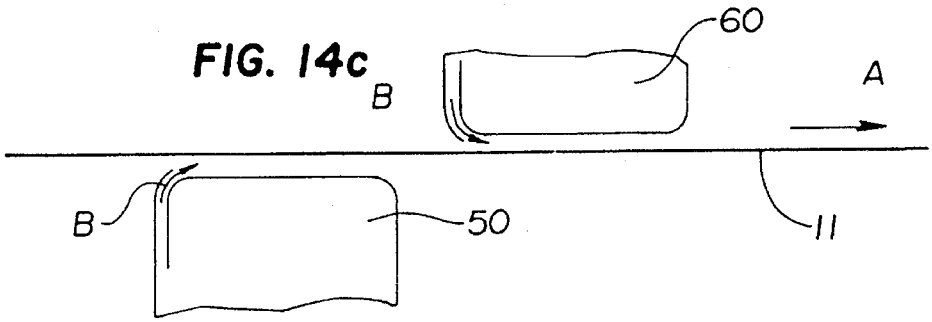
FIG. 14d
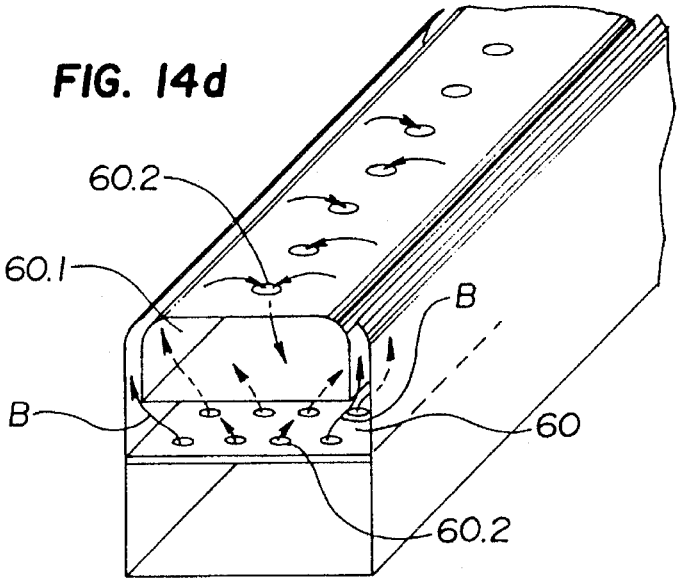

COATING DEVICE HAVING INFRARED AND SUSPENSION DRYING SECTIONS

BACKGROUND OF THE INVENTION

1. Field of the Invention

The invention relates to coating devices and in particular to devices for coating a paper web.

2. Description of Related Technology

The state of the art regarding paper coating devices is described in the following publications:

(1) DE-GM 8 414 413;

(2) U.S. Pat. No. 2,729,192;

(3) U.S. Pat. No. 2,946,307;

(4) U.S. Pat. No. 3,084,663;

(5) U.S. Pat. No. 5,112,653;

(6) EP Patent Application 93 112 695; and (7) EP 507 218 A1 (corresponding to U.S. Pat. No. 5,230,165).

With reference to FIG. 1 of publication (7), a known coating device has two applicator rolls which form a gap through which a paper web passes. A nozzle applicator station is assigned to each of the two applicator rolls where a coating composition film is applied onto a surface of a respective roll. The nozzle applicator station has a nozzle with two nozzle lips, one of which has a roller blade on a free end thereof. Thus, a metered application of a coating composition onto the surface of a particular roll is possible. Accordingly, such a device provides an indirect method of application of a coating onto paper because the coating is first applied onto a surface of the roll and is then transferred from the roll onto a paper web.

It is also possible to use applicator stations different from the one described in publication (7). Moreover, it may not be necessary to coat both sides of a paper web. Thus, for example, it may be possible to coat only one side of a paper web or to apply coating on both sides of a web but at different rates whereby several roll pairs are provided at an assigned applicator station and a paper web is dried each time it receives a coating.

Such coating devices have proven sufficient in the past. However, a problem with such devices that has not been satisfactorily addressed is known as the orange-peel effect wherein the coating is not flat on the paper web after the paper leaves the roll gap but rather has a surface that is reminiscent of the appearance of an orange peel. Many attempts have been made to eliminate the orange-peel effect, as, for example, by utilizing a smoothing or rubbing element connected to the coating device. Although such a measure makes it possible to ameliorate the undesirable orange-peel effect, it typically has not completely eliminated it. In addition, providing rubbing elements, for example, results in increased equipment cost.

SUMMARY OF THE INVENTION

It is an object of the invention to overcome one or more of the problems described above. It is also an object of the invention to provide a coating device that reduces or eliminates the orange-peel effect without any significant additional equipment expenditure.

According to the invention, a device for coating a paper web includes two applicator rolls disposed parallel to one another, forming a roll gap for the passage of a paper web therethrough. At least one applicator for applying a coating onto a surface of at least one of the rolls is also provided. The coating roll thereafter transfers the coating onto one side of a paper web disposed in the roll gap. Guide elements disposed downstream of the roll gap with respect to a direction of travel of the paper web through the device include at least one beam-like air guide element adapted to create an air cushion between the paper web and a surface of the air guide element facing the paper web. The air guide element may be disposed in such a manner as to deflect a paper web at least once downstream of the roll gap. Also, at least one air guide element is disposed directly downstream of the roll gap at a distance therefrom of about 0.3 to about 1 times the diameter of at least one of the rolls.

Other objects and advantages of the invention will be apparent to those skilled in the art from the following detailed description taken in conjunction with the drawings and the appended claims.

BRIEF DESCRIPTION OF THE DRAWINGS

FIG. 12 is a schematic view of a twelfth embodiment of a device according to the invention.

FIG. **12*a*** is a schematic view of an infrared drying section of a device according to the invention.

FIG. **12*b*** is a schematic view of a second embodiment of an infrared drying section of a device according to the invention.

Figure 13:
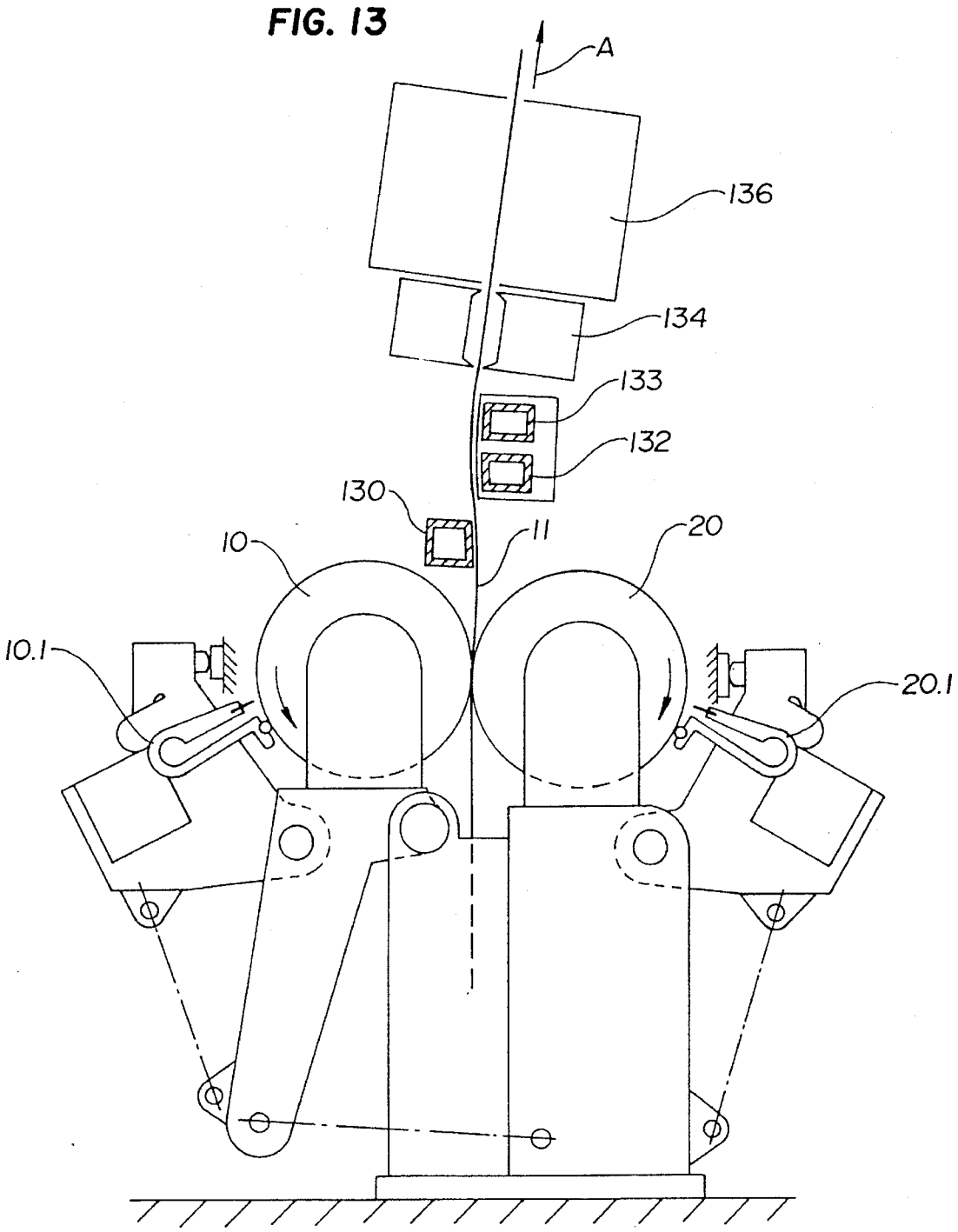

FIG. 13 is a cross-sectional and partially schematic view of a thirteenth embodiment of a device according to the invention.

FIG. **14*a*** is a partial perspective view of a beam-like air guide element according to the invention.

FIG. **14*b*** is a partial perspective view of a second embodiment of a beam-like air guide element according to the invention.

FIG. **14*c*** is a partial schematic view of a portion of a device according to the invention showing two beam-like air guide elements.

FIG. **14*d*** is a partial perspective view of a third embodiment of a beam-like air guide element according to the invention.

DETAILED DESCRIPTION OF THE INVENTION

In past attempts to reduce or eliminate the orange peel effect during paper coating, it has been discovered that the effect is influenced by numerous operational parameters. Thus, it is known that the orange peel effect is influenced by the type of coating composition utilized, for example, by its viscosity. The velocity of travel of a web through the device also plays a role. However, web velocity cannot be controlled because different paper qualities require different web velocities. The paper quality itself also plays a role in the orange peel effect, especially paper composition and surface characteristics. In addition, all parameters influence one another mutually so that it has previously been impossible to alleviate the orange peel problem in all cases.

Two parameters which previously have not been considered with regard to the orange peel effect problem appear to play a decisive role in the problem. One of these parameters is the angle of take-off, i.e., the angle at which the paper web leaves the roll gap after application of the coating. Another parameter is the web tension which exists in the paper web downstream of the roll gap with respect to the direction of travel of the web. Both of these parameters must be precisely adjusted. The second parameter presents some difficulties because the coated paper web, which is moist, cannot be allowed to run through a pair of tension rollers (i.e., a pair of driven rolls), which would hold the web under tension and thus transfer a certain tensile force onto the web. Thus, in light of the importance of the web take-off angle, a measure to apply a positive tensile force is utilized according to the invention which comprises disposing at least one air guide element directly downstream of the roll gap at a distance therefrom of about 0.3 to about 1 (preferably about 0.5 to about 0.8) times the diameter of one of the coating rolls. In this way, ideal coating conditions can be created.

Also according to the invention, directly downstream of at least one beam-like air guide element is a dryer portion that may include air floater-type (i.e., suspension) and infrared dryers. The air outlet velocity from the beam-like guide elements as well as into the air floater-type dryers can be accurately adjusted. Furthermore, the infrared dryer is particularly disposed in relation to the air floater-type dryers. Finally, both the air floater-type dryers and the infrared dryers each preferably have a certain length with respect to the direction of movement of a web through the device.

In the past it was not possible to place an infrared dryer directly downstream of the roll gap formed by two applicator rolls of a coating station. This is because the point of separation of the paper web from one of the rolls is typically not well-defined as it oscillates with respect to the direction of movement of a web through the device. However, placing an infrared dryer near the roll gap is possible according to the invention by utilizing an air guide element according to the invention directly downstream of the roll gap. Installation of an infrared dryer near the roll gap is especially preferred because the infrared radiation penetrates deeply into the paper web, has a high energy density, and heats the water contained in the paper web, so that in the downstream floater-type dryer section evaporation can be achieved relatively easily.

Various embodiments of devices according to the invention concern the placement of a first infrared dryer of the drying portion of the device disposed downstream of the roll gap. In some embodiments of the invention, the first infrared dryer is disposed immediately after at the beam-like air guide element (of which there is at least one). However, in some cases, it is desirable to dispose the infrared dryer at about the same slight distance from the roll gap as the beam-like air guide element. Thus, in such an embodiment of a device according to the invention, an infrared dryer is provided which itself can produce a carrier-air cushion between it and the coated paper web.

Figure 1:
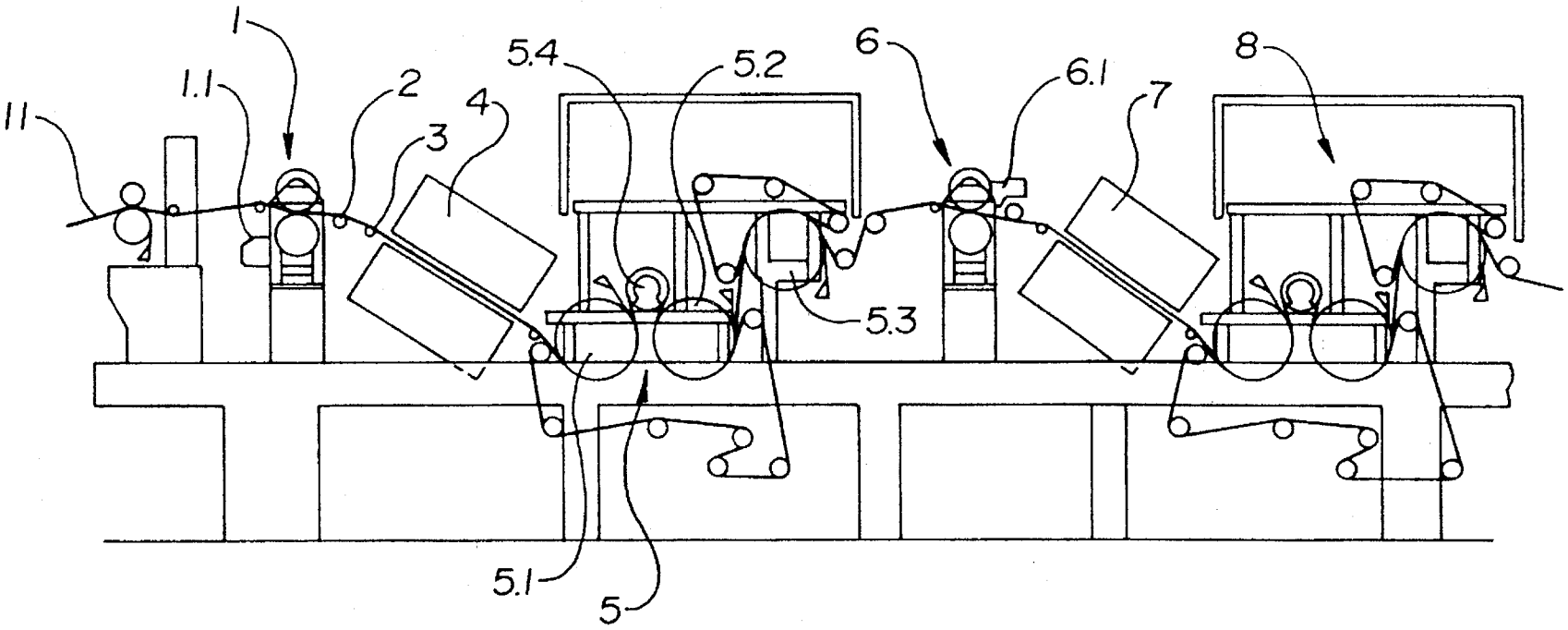
FIG. 1 is a schematic view of a device according to the invention.

With reference to the drawings, FIG. 1 shows a coating installation device according to the invention having two coating stations with drying devices disposed therebetween. FIGS. 2 to 5 show coating stations to which guide elements are connected in various configurations.

FIG. 1 shows a first coating station, generally 1, which has two coating rolls. An applicator station 1.1 is assigned to one of the two rolls. A tensile device is disposed downstream of the coating station with reference to the direction of travel of a paper web 11 through the device. The tensile device includes two beam-like air guide elements 2 and 3. Downstream of the elements 2 and 3 is an infrared dryer section 4, a short drying portion, generally 5, having three drying cylinders 5.1, 5.2 and 5.3, a suction guide roll 5.4 and a number of guide rolls. A second coating station, generally 6, also has two rolls. An applicator station 6.1 is assigned to one of the rolls. Downstream of the coating station 6 is an infrared dryer section 7 and then a final dryer group, generally 8.

Figure 2:
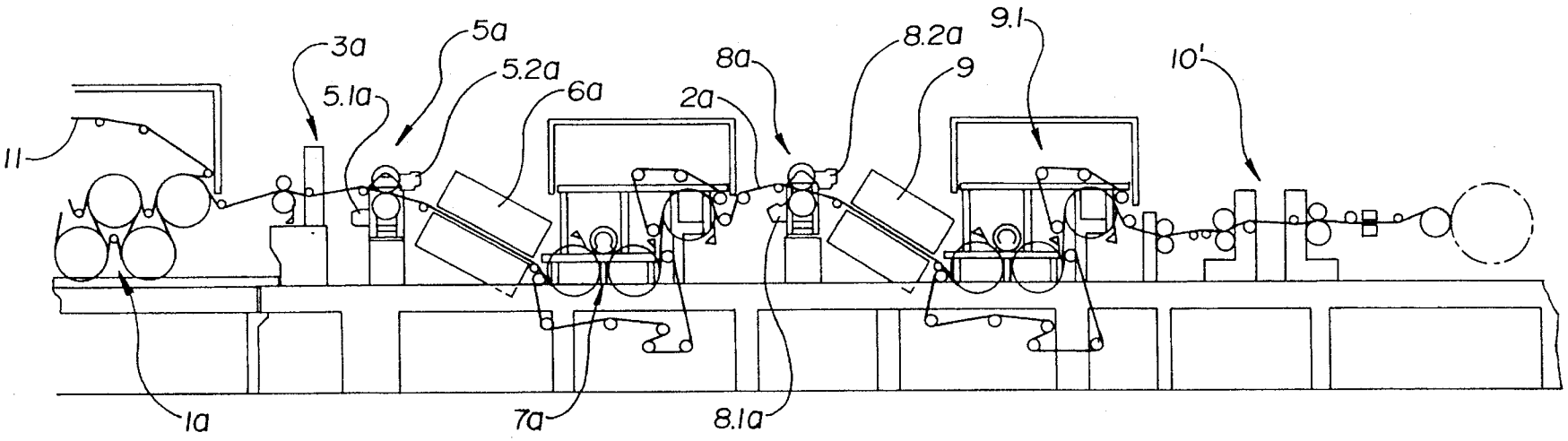
FIG. 2 is a is a schematic view of a second embodiment of a device according to the invention.
Figure 3:
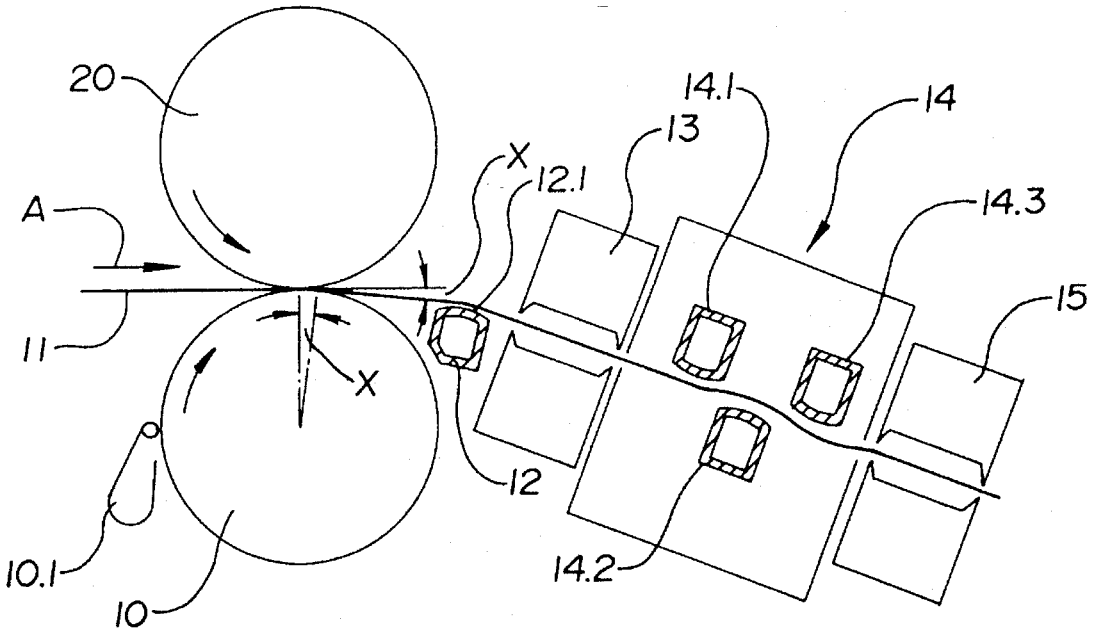
FIG. 3 is an enlarged and partial schematic view of a third embodiment of a device according to the invention.

A device according to the invention shown in FIG. 2 includes a two-row cylinder dryer portion, generally 1*a* (only one end thereof is shown). Downstream of the dryer portion 1*a*, with respect to the direction of travel of a paper web 11 through the device are a calender 3*a*, a first coating station, generally 5*a*, followed by a dryer 6*a* and a dryer portion, generally 7*a*, having drying cylinders, a second coating station, generally 8*a*, another dryer 9, a dryer portion 9.1 with drying cylinders and a roll-up station, generally 10'.

Each of the two coating stations 5*a* and 8*a* have two nozzle applicator stations 5.1*a*, 5.2*a* and 8.1*a* and 8.2*a*, respectively. This means that the paper web 11 can be coated on both sides in each coating station. The dryers 6*a* and 9 are floater-type dryers which carry the web 11 in a free-floating manner and bring the web to such a dry content (at least 70% dry) that the coating on the paper can be touched in the downstream cylinder drying groups 7*a* and 9.1, respectively.

FIGS. 3–6 each show coating stations, air guide elements and drying devices according to the invention. The coating station shown in FIG. 3 includes two rolls 10 and 20 of substantially equal diameter D. A nozzle applicator station 10.1 is assigned to the roll 10. The other roll 20 does not have such an applicator station. A paper web 11 is guided through a roll gap formed by the rolls 10 and 20 in the direction of the arrow A. Downstream of the roll gap is a guide element in the form of a beam-like air guide element 12. The air guide element 12 (shown schematically) includes a hollow profile beam which has a plurality of bores 12.1 on a side of the beam that faces the paper web 11. The bores 12.1 extend over the entire length of the air guide element 12 and thus over the entire width of the paper web 11.

Downstream of the air guide element 12 with respect to the direction of travel of the paper web 11 is an infrared dryer section 13, followed by a floater-type dryer section, generally 14. The floater-type dryer section 14 also has air guide elements 14.1, 14.2, 14.3 similar to the air guide element 12. The air outlet velocity from the floater-type dryer section 14 is preferably between about 20 m/s and about 80 m/s.

The paper web 11 is guided through the device as follows: After the web passes through the vertex (roll gap) of the two rolls 10 and 20, the paper web 11 first loops around the roll 10 at a selected angle of wrap x (preferably between about 0° and about 5°). The web 11 then loops around the beam-like air guide element 12, where it undergoes another slight deflection. Further deflections of the paper web 11 occur within the floater-type dryer section 14 as the web 11 is conveyed through the air guides 14.1, 14.2, and 14.3.

Another infrared dryer section 15 is disposed downstream of the floater-type dryer section 14.

It is important that the first dryer disposed downstream of the beam-like air guide element 12 be an infrared dryer. In other words, if the guide element 12 is disregarded, the location of the infrared drying section 13 is immediately downstream the coating station rolls 10 and 20. Furthermore, it is preferred that the entire drying portion of the coating device according to the invention has more than two drying sections, particularly preferred is at least three drying sections, and that the infrared drying sections and the floater-type drying sections alternate.

Figure 4:
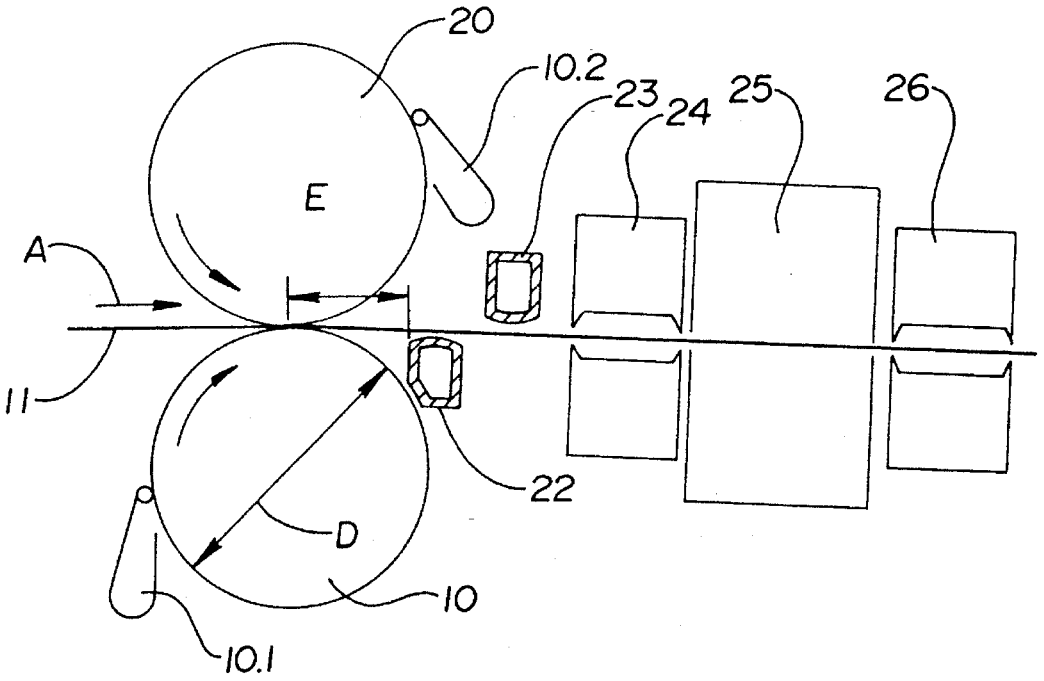
FIG. 4 is an enlarged and partial schematic view of a fourth embodiment of a device according to the invention.

FIG. 4 illustrates a portion of an embodiment of a device according to the invention also having two applicator rolls 10 and 20. In contrast to the embodiment according to FIG. 3, nozzle applicator stations 10.1 and 10.2 are assigned to rolls 10 and 20, respectively. Thus, a paper web 11 receives a coating on both sides. However, the nozzle 10.1 can be omitted, so that only one side of the paper web 11 receives a coating.

Downstream of the roll gap formed by the rolls 10 and 20 are two beam-like air guide elements 22 and 23 disposed on opposite sides of the paper web 11. Downstream of the air guide element 23 is an infrared drying section 24, a floater-type drying section 25 and an infrared drying section 26. The three drying sections 23, 24, and 25 are of equal lengths with respect to the direction of travel of the paper web 11 through the device.

With respect to FIG. 4, the paper web 11 leaving the roll gap loops around the roll 10 only very slightly. The angle of wrap x is so small that it cannot be seen in FIG. 4. The looping of the web 11 around the air guide elements 22 and 23 is also very slight (also cannot be seen in FIG. 4).

Figure 5:
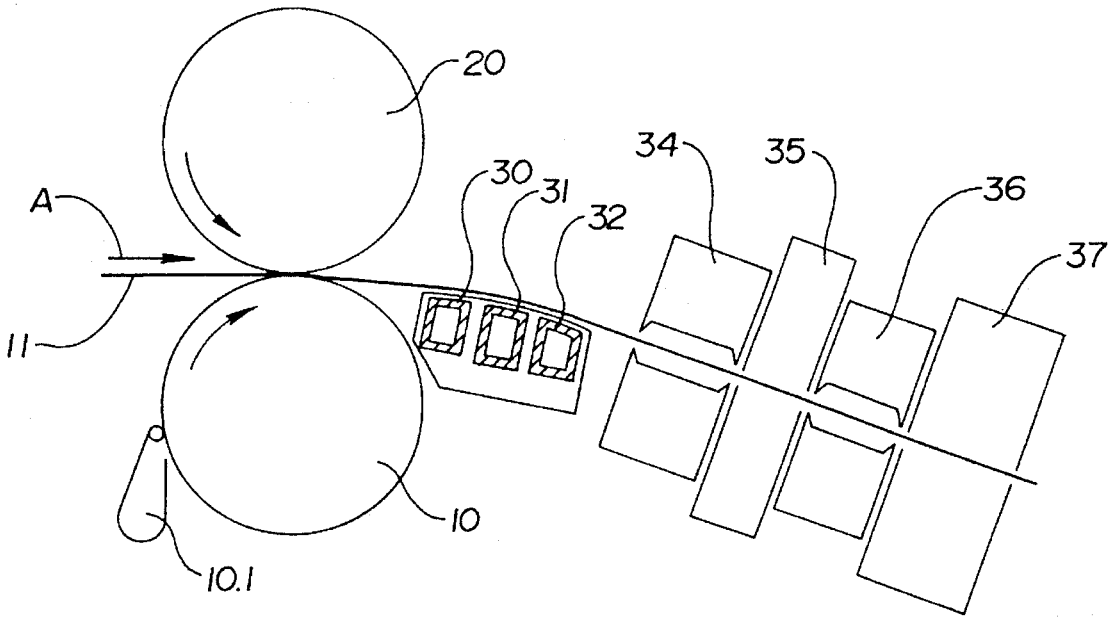
FIG. 5 is a an enlarged and partial schematic view of a fifth embodiment of a device according to the invention.

In an embodiment of a device according to the invention shown in FIG. 5, a roll gap is formed by the coating applicator rolls 10 and 20. Only the roll 10 has an applicator station 10.1 assigned thereto. A bank of three beam-like air guide elements 30, 31, 32 are disposed downstream of the roll gap with respect to the direction of travel of a paper web 11 shown by an arrow A. Downstream of the air guide element 32 is an infrared drying section 34, a floater-type drying section 35, another infrared drying section 36, and another floater-type drying section 37. The two floater-type drying sections are of the same length with respect to the direction of travel of the web 11 through the device. However, the floater-type drying section 37 is longer than floater-type drying section 35. The reason for this is that the paper web 11, and especially the water contained in the web, must be heated by an infrared drying section and only then enter a floater-type drying section. Because of the increasing dry content of the web, such heating requires more and more heat output, i.e., longer floater-type drying sections, in order to drive out residual water from the paper web. An infrared drying section preferably has a length of about 300 mm to about 700 mm and a floater-type drying section preferably has a length of about 50 mm to about 400 mm.

Figure 6:
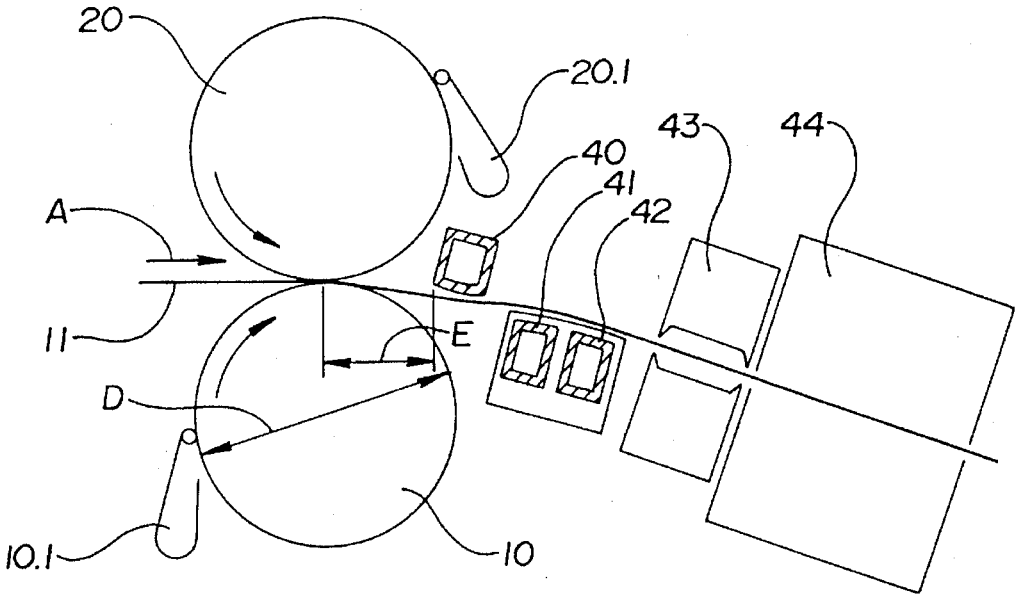
FIG. 6 is an enlarged and partial schematic view of a sixth embodiment of a device according to the invention.

In an embodiment of a device according to the invention shown in FIG. 6, a paper web 11 is coated on both sides in a roll gap formed by the rolls 10 and 20 having applicator stations 10.1 and 20.1, respectively, assigned thereto. With respect to the direction A of a paper web 11 traveling through the device, downstream of the roll gap is a beam-like air guide element 40 disposed at one side of the web 11, followed by a bank of beam-like air guide elements 41 and 42 disposed on the opposite side of the paper web 11. An infrared section 42 and a floater-type drying section 43 are disposed downstream of the air guide elements 41 and 42.

With reference to the small distance E between the roll gap and the element 40, it can be seen that the element 40 ensures an unequivocally defined separation point between the web 11 and the roll 10. Thus, the separation point does not oscillate back and forth. If a coating composition is applied to only one side of the web 11, the roll 10 is utilized the applicator roll, and there is a relatively low angle of wrap x (see, e.g. FIG. 3), then the roll 10 can have a softer surface than the supporting roll 20. This is quite unusual because normally the web 11 follows and loops around the harder roll of a roll coating roll pair.

Figure 7:
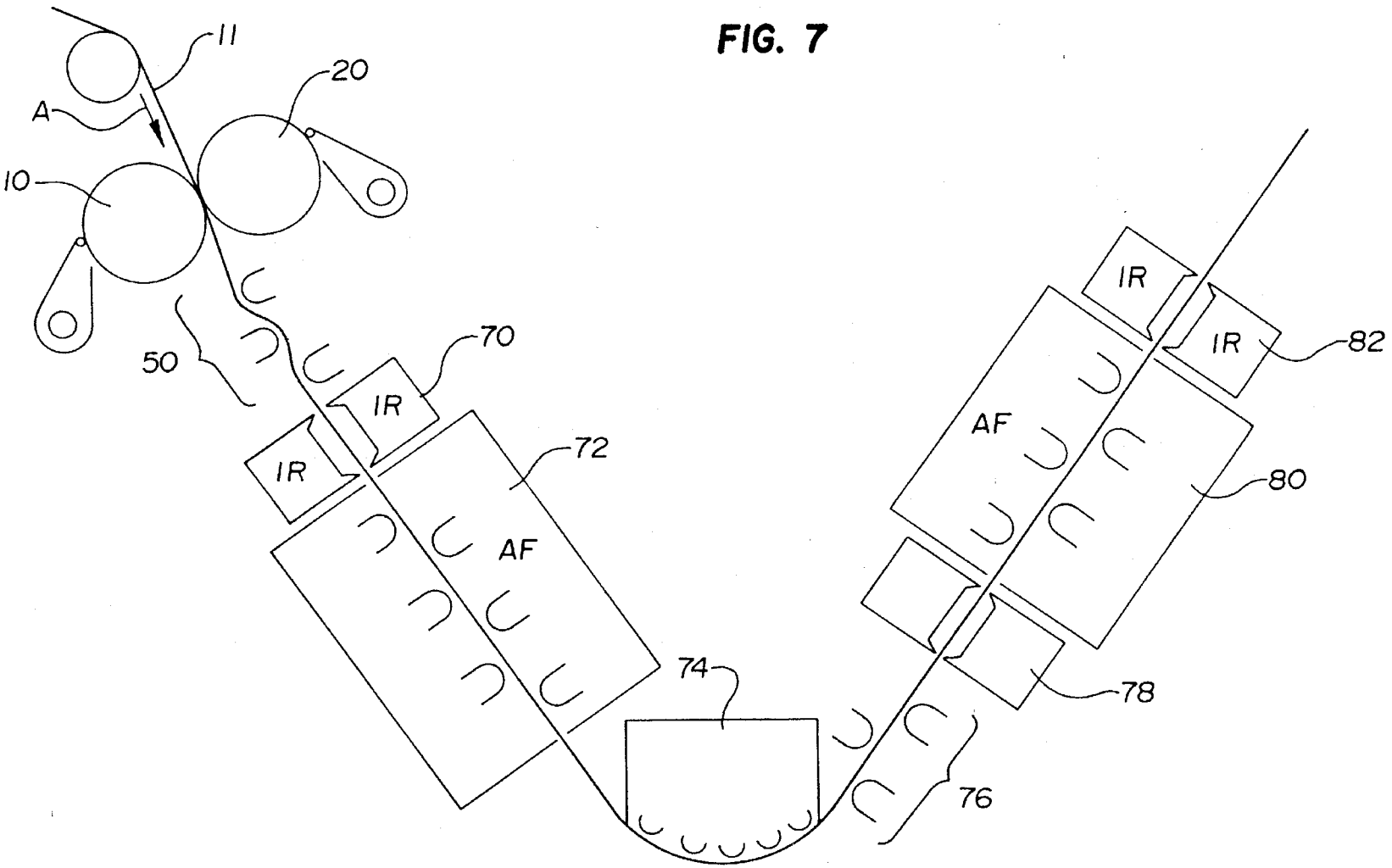
FIG. 7 is a schematic view of a seventh embodiment of a device according to the invention.

FIG. 7 shows another embodiment of a device according to the invention. Two applicator rolls 10 and 20 are disposed in such a way that a paper web 11 goes through the roll gap at an angle of about 20° to the vertical. Three beam-like air guide elements 50 are disposed downstream of the rolls 10 and 20 with respect to the direction of travel A of the web 11 through the device. Downstream of the elements 50 is a drying portion of the device, the elements of which are not shown in detail. The drying portion includes an infrared drying section 70 disposed directly downstream of the elements 50. Downstream of the drying section 70 is a floater-type drying section 72, then a deflection device 74, which is also equipped with beam-like air guide elements, followed by three beam-like air guide elements 76 which ensure that after the deflecting device, the paper web 11 assumes a satisfactory stable run. Downstream of the elements 76 is an infrared drying section 78, a floater-type drying section 80 and finally another infrared drying section 82. Thus, the paper web 11 assumes a V-shaped path. The two arms of the V-shaped path can be at different angles to one another, but should be at an angle between about 10° and about 60° to the horizontal.

Figure 8:
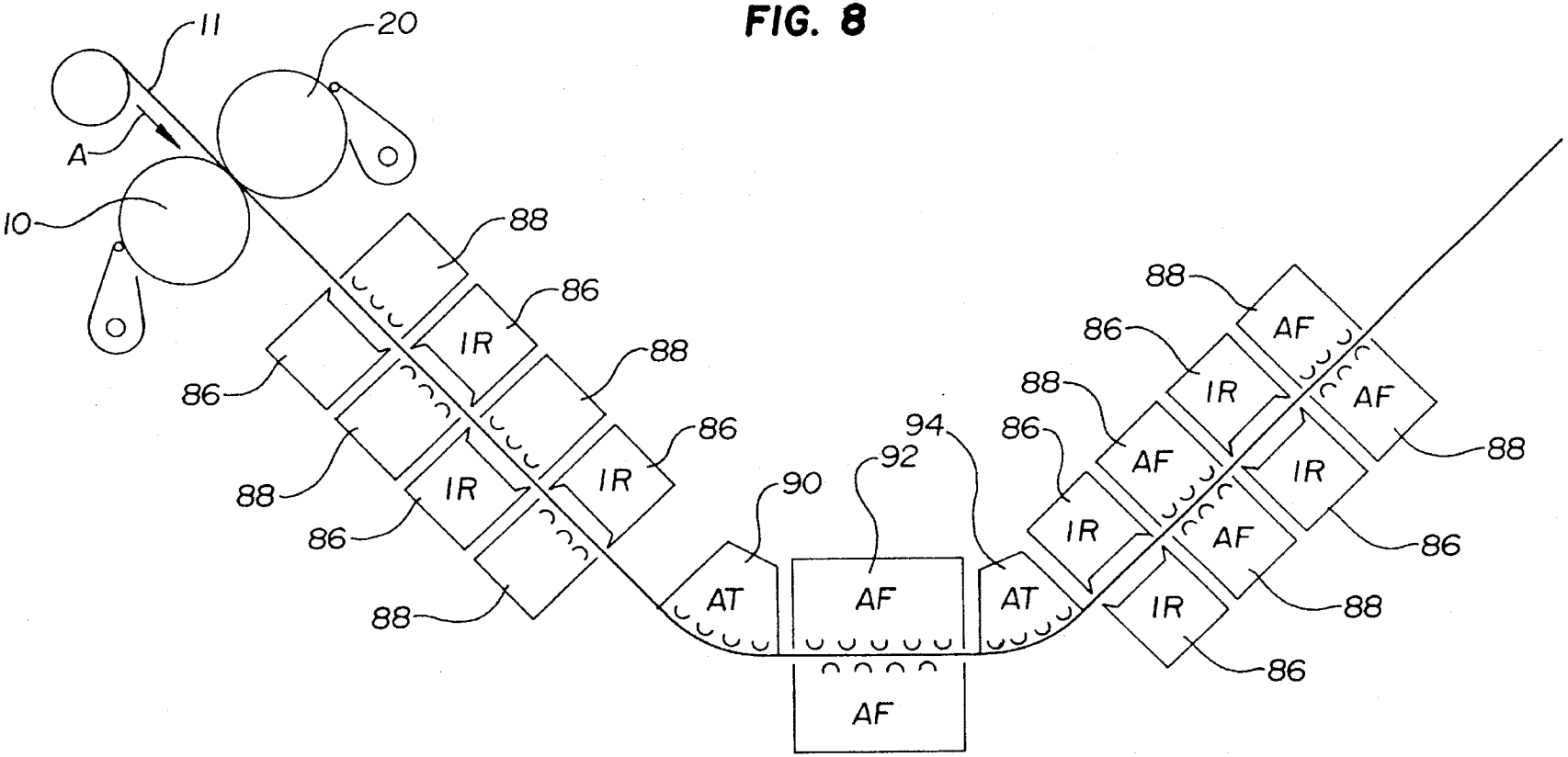
FIG. 8 is a schematic view of an eighth embodiment of a device according to the invention.

An embodiment of a device according to the invention shown in FIG. 8, also includes coating applicator rolls 10 and 20, each having an applicator station assigned thereto. Downstream of the rolls 10 and 20 with respect to the direction A of travel of a paper web 11 through the device, two types of drying sections, i.e., infrared drying sections 86 and floater-type drying sections 88, are disposed at either side of a paper web 11 opposite to one another, with each type of drying section in alternating arrangement with respect to the direction of travel of the paper web 11. Downstream of these alternating dryers is a bank of beam-like air guide elements 90, followed by a floater-type dryer section 92 and then another bank of air guide elements 94 which guide the web 11 in a V-shaped path. Downstream of the guide elements 94 is another group of infrared 86 and floater-type 88 dryer sections. However, in this group of dryer sections, two identical type drying sections are disposed opposite one another. Other arrangements of dryers are also possible. Thus, first and second arms of a V-shaped path as shown in FIG. 8 could be configured identically.

Figure 9:
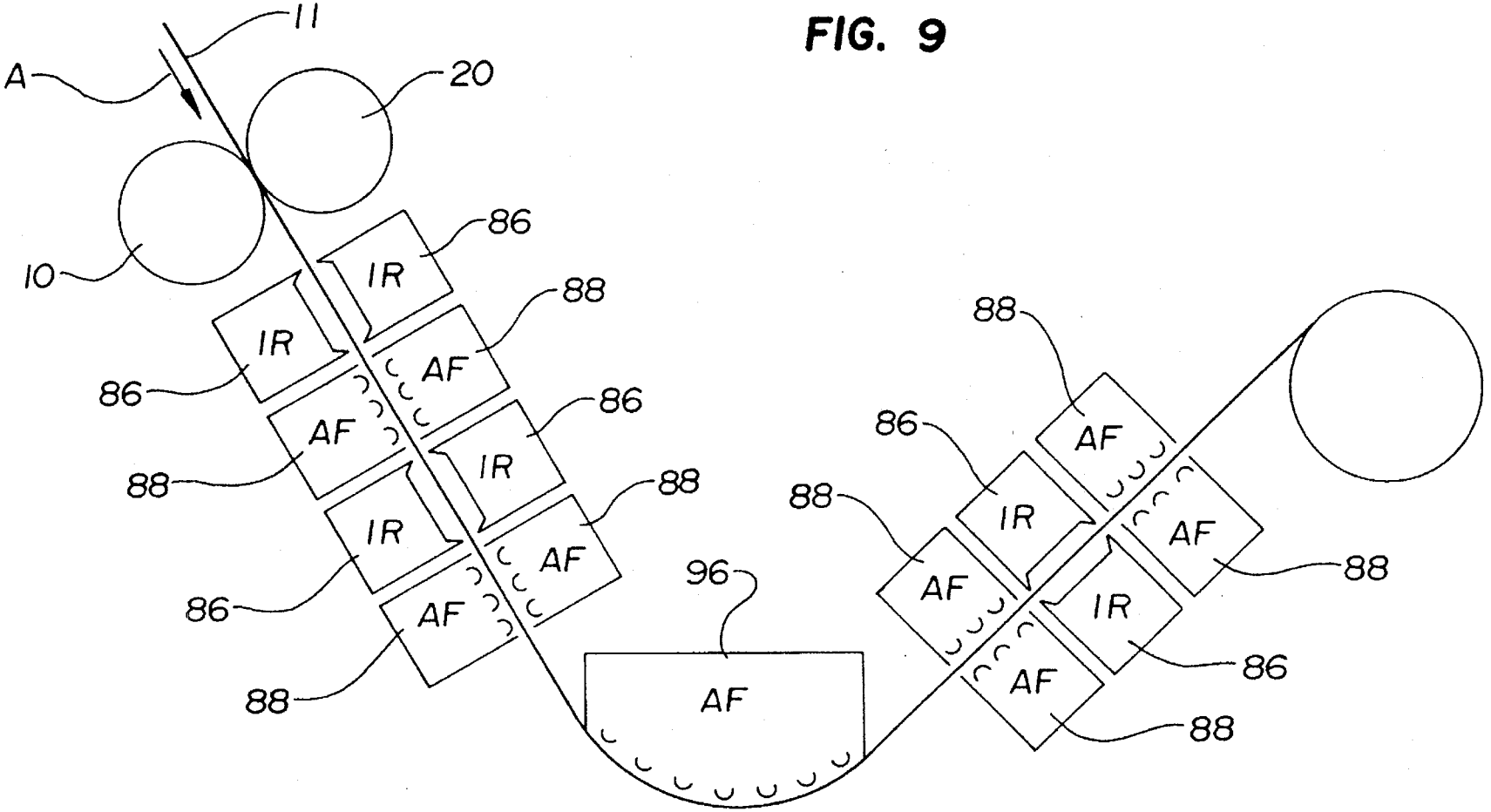
FIG. 9 is a schematic view of a ninth embodiment of a device according to the invention.

An embodiment of a device according to the invention shown in FIG. 9 includes the elements 10, 20, 86, and 88 identical in function to elements 10, 20, 86, and 88, respectively, shown in FIG. 8. A floater-type drying section 96 deflects the paper web 11, resulting in a V-shaped path. However, the same types of drying sections are disposed on opposite sides with respect to the two arms of the V-shaped path.

Figure 10:
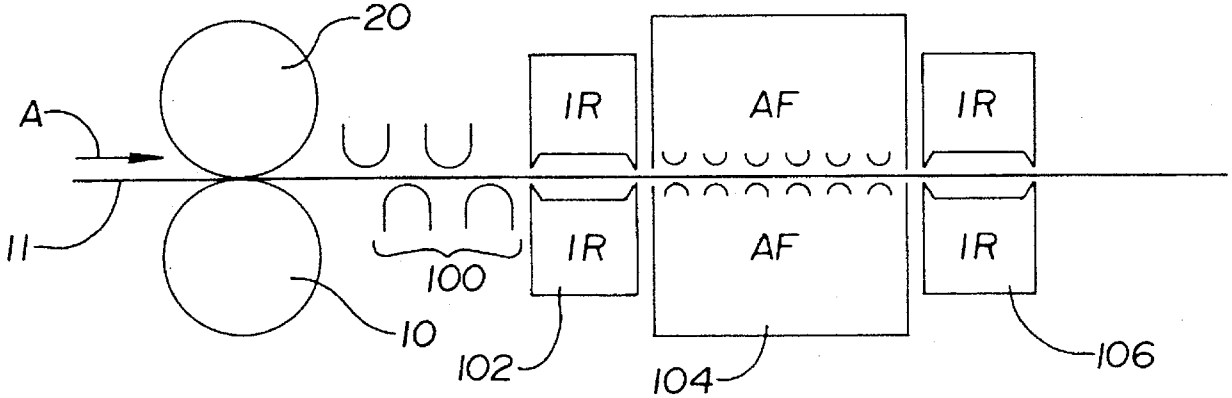
FIG. 10 is a schematic view of a tenth embodiment of a device according to the invention.

In an embodiment of a device according to the invention shown in FIG. 10, a paper web 11 runs essentially in a straight line through the entire device through two applicator rolls 10 and 20, a bank of beam-like air guide elements 100, an infrared drying section 102, a floater-type drying section 104 and another infrared drying section 106.

Figure 11:
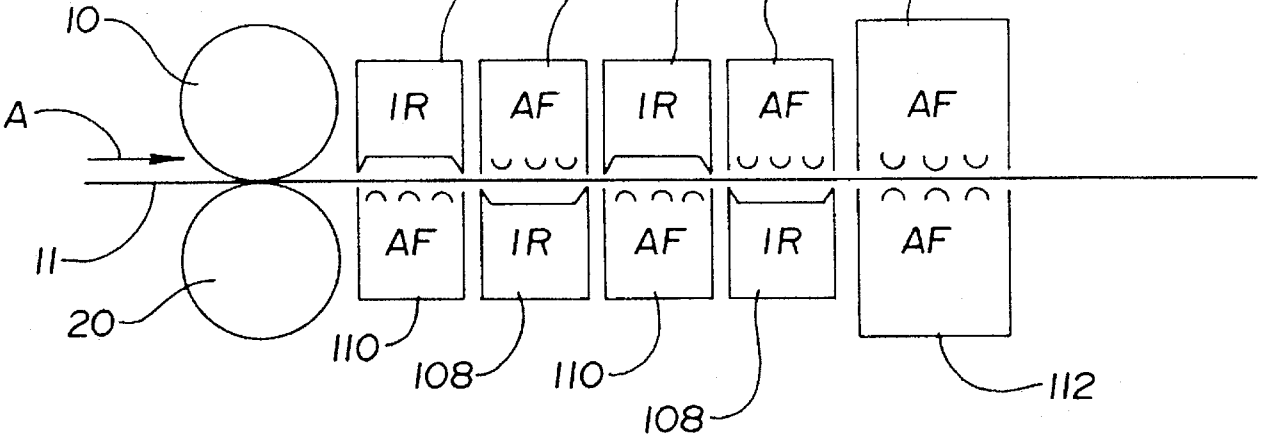
FIG. 11 is a schematic view of an eleventh embodiment of a device according to the invention.

In an embodiment of a device according to the invention shown in FIG. 11, a paper web 11 runs essentially in a straight line through the entire device through two applicator rolls 10 and 20, infrared dryers 108 and floater-type dryers 110, with these different dryers being disposed opposite one another. Disposed downstream of the alternating dryers is another floater-type dryer 112.

An embodiment of a device according to the invention shown in FIG. 12, also includes coating applicator rolls 10 and 20, each having an applicator station assigned thereto. Downstream of the rolls 10 and 20 with respect to the direction A of travel of a paper web 11 through the device, two types of drying sections, i.e., infrared drying sections 116 and floater-type drying sections 118, are disposed at either side of a paper web 11 opposite to one another similar to the configuration of drying sections shown in FIG. 9. Downstream of the first bank of alternating dryers is a floater-type dryer section 120 followed by another bank of alternating dryers 116 and 118. However, in contrast to the device shown in FIG. 9, in the device shown in FIG. 12, beam-like air guide elements are integrated into the elements of the infrared drying sections. As shown in FIG. 12*a*, the individual infrared dryer elements are designed in such a way that they can create a carrier-air cushion between themselves and the coated paper web. FIG. 12*b* shows another embodiment of an infrared drying section 116'.

An embodiment of a device according to the invention shown in FIG. 13 shows the applicator rolls 10 and 20 rotatably attached to the device and the associated application stations 10.1 and 20.1 in greater detail. In this embodiment a web 11 travels through the roll gap formed by the rolls 10 and 20 from beneath these roles and travels in an upward direction. The web 11 does not necessarily travel vertically; it can also be inclined to the vertical. The coating composition can be applied to one side or to both sides. The device includes downstream (with respect to the direction of travel A of the web 11 through the device) elements 130, 132, 133, 134, and 136, similar in function to the elements 40, 41, 42, 43, and 44, shown in FIG. 6.

FIGS. 14*a* to 14*d* show embodiments of beam-like air guide elements according to the invention.

With reference to FIG. 14*a*, a beam-like air guide element 150 has a single line of bores 152 from which air flows out. The bores 152 are disposed in a straight line.

With reference to FIG. 14*b*, a beam-like air guide element 154 has bores 156 displaced with respect to one another. In other words, two rows of bores 156 are disposed transversely to the direction of movement of a web through the device, i.e., along a straight line.

In an embodiment shown in FIG. 14*c*, two beam-like air guide elements 50 and 60 carry a paper web 11 therebetween. The direction of movement of the web 11 is indicated by an arrow A. The two air guides 50 and 60 have slits. The slits can extend over the entire width of the web 11 (i.e., over the entire length of the individual beam-like elements). Also, several such slits per beam-like element can be disposed behind one another. The slit in each beam-like element is always upstream with respect to the oncoming paper web 11. An air curtain illustrated by the arrows B flows from the slit.

In the embodiment shown in FIG. 14*d*, a beam-like air guide element 60 has air slits on both edge regions thereof which extend over the entire width of a paper web 11 and also over the entire length of the guide element 60. Here, again, arrows B are shown to indicate an air curtain exiting the slits. The guide element 60 has a box-like hollow body 60.1 therewithin extending over the width of the paper web. The box-like body 60.1 has a row of bores 60.2. Air which was introduced through the slits is aspirated through the bores 60.2 and then removed on a side of the box 60.1 (not shown). This configuration provides a stable air cushion. In order to create a uniform pressure of the air curtains a perforated plate 60.2 is provided in the hollow beam-like element 60.

The foregoing detailed description is given for clearness of understanding only, and no unnecessary limitations should be understood therefrom, as modifications within the scope of the invention will be apparent to those skilled in the art.

We claim:

1. A device for coating a paper web comprising:

(a) two rolls disposed parallel to one another and forming a roll gap for the passage of a paper web therethrough;

(b) at least one applicator for applying a coating onto a surface of at least one of the rolls, for subsequent transfer of the coating onto one side of the paper web in the roll gap;

(c) guide elements disposed downstream of the roll gap with respect to a direction of travel of the paper web through the device, said guide elements guiding the paper web and comprising at least one air guide beam for creating an air cushion between the paper web and a surface of the at least one air guide beam facing the paper web, said at least one air guide beam being disposed in such a manner as to deflect the paper web at least once downstream of the roll gap, and said at least one air guide beam being disposed directly downstream of the roll gap at a distance therefrom of about 0.3 times to about 1 time a diameter of at least one of the rolls; and (d) a drying portion disposed directly downstream of the at least one air guide beam for drying both sides of the paper web, said drying portion having a plurality of infrared drying sections and a plurality of suspension drying sections, said infrared drying sections and suspension drying sections being alternately disposed with respect to the direction of movement of the web through the device.

2. The device of claim 1 wherein the at least one air guide beam disposed directly downstream of the roll gap is at a distance of about 0.5 to about 0.8 times the diameter of the roll from the roll gap.

3. The device of claim 1 wherein an air outlet velocity from the suspension drying sections is between about 20 m/s and about 80 m/s.

4. The device of claim 1 wherein each infrared drying section has a length of about 300 mm to about 700 mm and each suspension drying section has a length of about 50 mm to about 400 mm, said lengths being measured in the direction of movement of the web through the device.

5. The device of claim 1 wherein said guide elements further comprise at least two air guide beams for deflecting the paper web conveyed therethrough at least twice in opposite directions forming an S-shaped path.

6. The device of claim 1 wherein said guide elements further comprise at least one air guide beam positioned so as to cause the paper web to wrap around one of the two rolls after the roll gap.

7. The device of claim 6 wherein an angle of wrap of the paper web about the roll is between about 0° and about 5°.

8. The device of claim 1 wherein said guide elements further comprise a plurality of air guide beams combined to form a bank of air guide elements.

* * * * *